US005544641A

United States Patent [19]

Jenn

[11] Patent Number: 5,544,641

[45] Date of Patent: Aug. 13, 1996

[54] ARROW STORING MEANS AND AIMING MEANS FOR A CROSSBOW

[76] Inventor: Chin S. Jenn, No. 23-6, Ping Ho St., Ta Lin Chen, Chia I Hsien, Taiwan

[21] Appl. No.: 267,899

[22] Filed: Jul. 6, 1994

[51] Int. Cl.[6] ..... F41B 5/12

[52] U.S. Cl. ..... 124/25; 124/25.5; 124/52

[58] Field of Search ..... 33/241, 265; 42/103; 124/25, 25.5, 25.7, 52, 53, 86, 87, 88; 362/110, 113, 114

[56] References Cited

U.S. PATENT DOCUMENTS

| | | | |
|---|---|---|---|
| 1,215,171 | 2/1917 | Lewis | 362/110 X |
| 1,985,079 | 12/1934 | Conklin | 124/25 |
| 2,516,341 | 7/1950 | Raffeis | 124/25 X |
| 2,825,324 | 3/1958 | Haas | 124/52 X |
| 3,739,765 | 6/1973 | Moore | 124/25 |
| 3,820,248 | 6/1974 | Hayward | 33/241 |
| 3,968,783 | 7/1976 | Pfotenhauer | 124/25 |
| 4,152,754 | 5/1979 | De Filippis et al. | 362/113 |
| 4,707,772 | 11/1987 | Jimenez et al. | 362/110 |
| 4,939,863 | 7/1990 | Alexander et al. | 42/103 |
| 5,040,885 | 8/1991 | Simms | 42/103 X |

FOREIGN PATENT DOCUMENTS

| | | | |
|---|---|---|---|
| 1074453 | 1/1960 | Germany | 124/152 |
| 422231 | 6/1935 | United Kingdom | 124/52 |

*Primary Examiner*—Eric K. Nicholson
*Assistant Examiner*—John A. Ricci
*Attorney, Agent, or Firm*—Bacon & Thomas

[57] ABSTRACT

The present invention provides an arrow storing device and an aiming device for a crossbow, the arrow storing device has a magazine in which a plurality of arrows are received, and which is replaceably engaged in a frame of the crossbow. The magazine has a plate on which the arrows are disposed and a spring is disposed under the plate to push the plate upwardly. The aiming device includes a tube having first and second ends, a convex lens being disposed in the first end thereof and a bulb being movably engaged in the second end thereof such that, at times of poor visibility, a spot of light will be projected on a target by adjusting the position of the bulb.

15 Claims, 9 Drawing Sheets

ARROW STORING MEANS AND AIMING MEANS FOR A CROSSBOW

BACKGROUND OF THE INVENTION

The present invention relates to an arrow storing means and an aiming means for a crossbow and more particularly, to an arrow storing means having a magazine with a plurality of arrows received therein and an aiming means with a convex lens and a bulb disposed therein.

A crossbow generally includes a bow, a bow string, a frame and an activating means. A user first pulls the bow string away from the bow and lets the bow string be retained by a suitable device of the crossbow, then the user loads an arrow in a groove defined in the frame and pulls a trigger of the activating means to release the bow string which is therefore returned back to its original position and meanwhile exerts a force to the arrow to propel it. It is noted that the user can load only one arrow to the crossbow. Furthermore if the user wants to use the crossbow at a time of poor visibility, such as night, he will find it is hard to aim at a target and a random shooting is dangerous.

The present invention intends to provide an arrow storing means and an aiming means for a crossbow to mitigate and/or obviate the above-mentioned problems.

SUMMARY OF THE INVENTION

The present invention provides an arrow storing means and an aiming means for a crossbow. The arrow storing means has a magazine in which a plurality of arrows are received, and which is replaceably engaged in a frame of the crossbow. The magazine has a plate on which the arrows are disposed and a spring is disposed under the plate to push the plate upwardly. The aiming means includes a tube having first and second ends, a convex lens being disposed in the first end thereof and a bulb being movably engaged in the second end thereof such that a spot will be projected on a target by adjusting the position of the bulb enabling a user to see a target in poor visibility.

Objects, advantages, and novel features of the invention will become more apparent from the following detailed description when taken in conjunction with the accompanying drawings.

DETAILED DESCRIPTION OF THE PREFERRED EMBODIMENT

Figure 1:
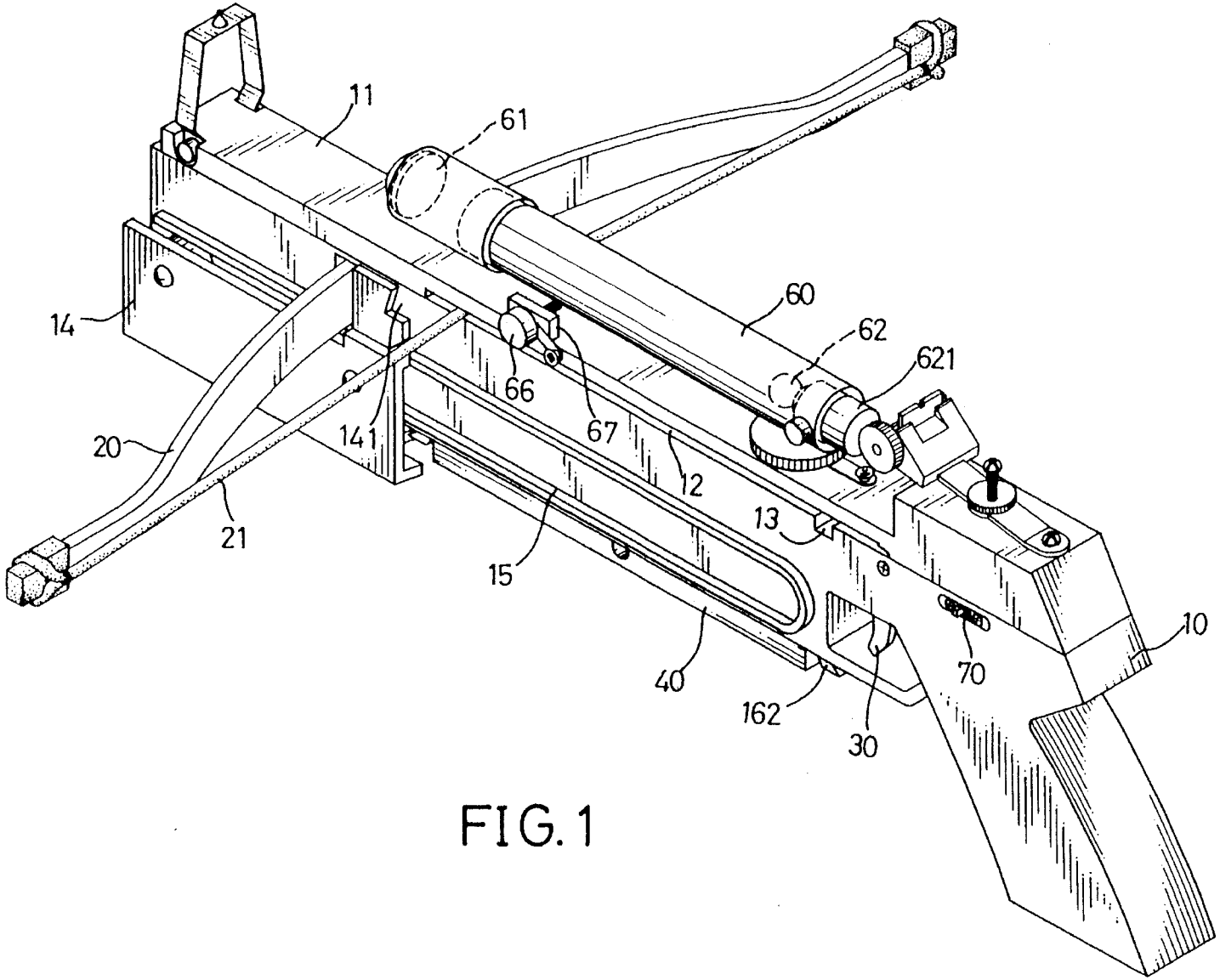
FIG. 1 is a perspective view of a crossbow, including a frame and a bow, equipped with an arrow storing means and an aiming means in accordance with the present invention.
Figure 2:
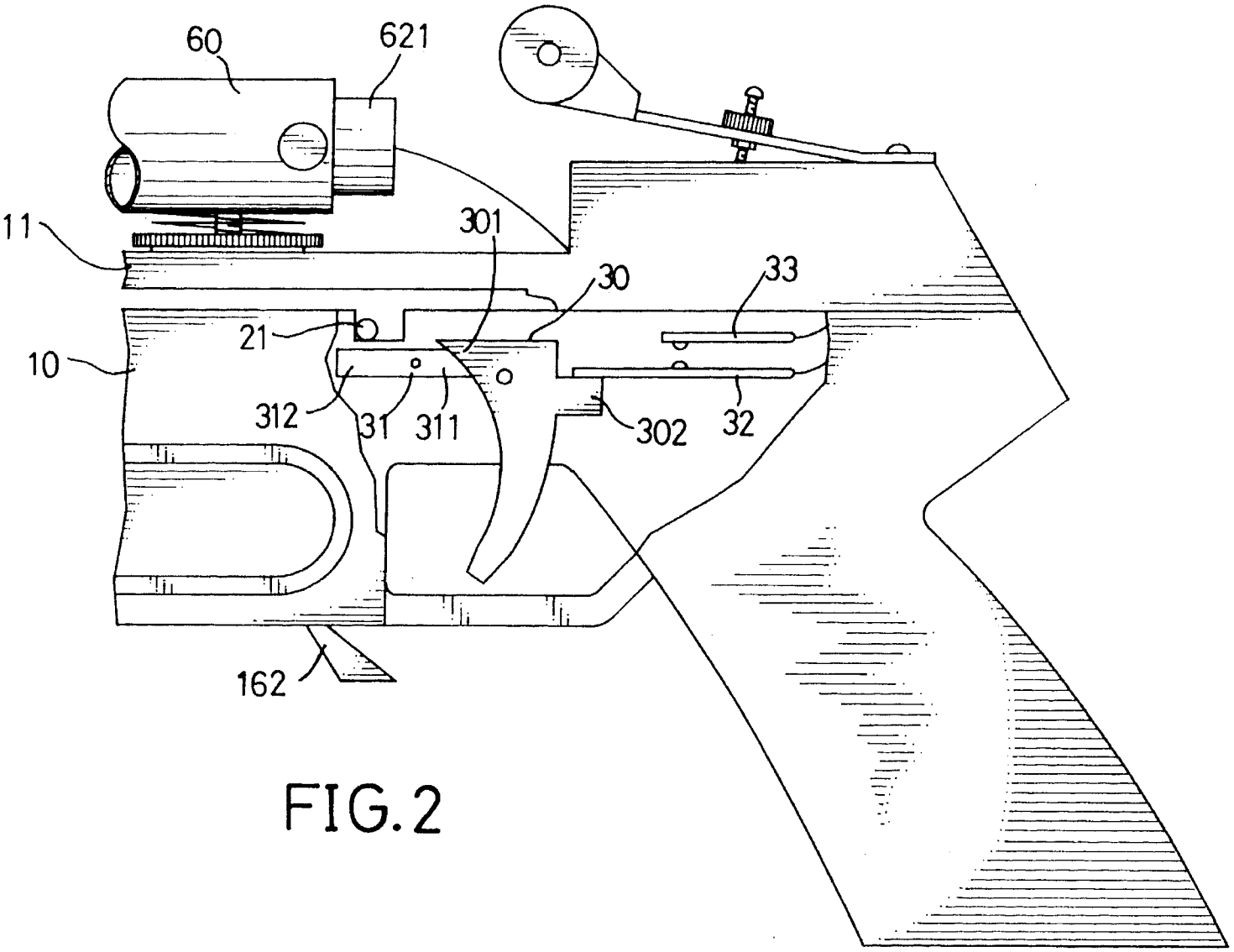
FIG. 2 is a partial cut away side elevational view of an activating means in accordance with the present invention.
Figure 3:
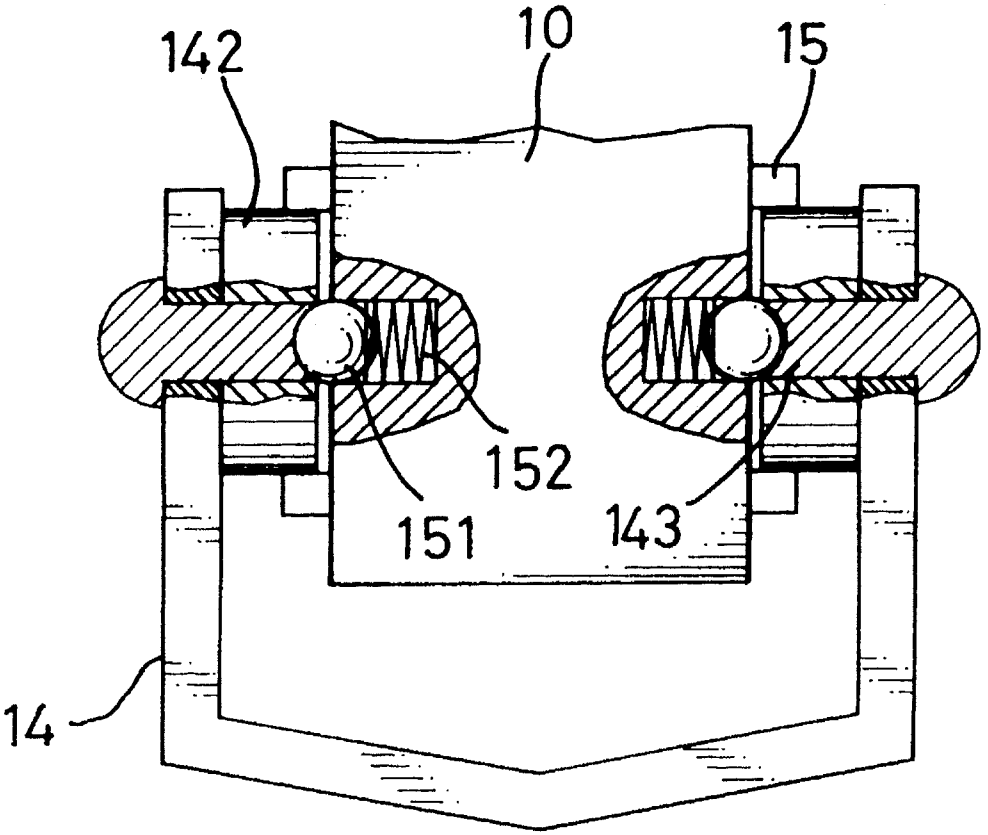
FIG. 3 is a side elevational view, partly in section, of a pulling bracket slidably engaged to a frame of the crossbow in accordance with the present invention.
Figure 4:
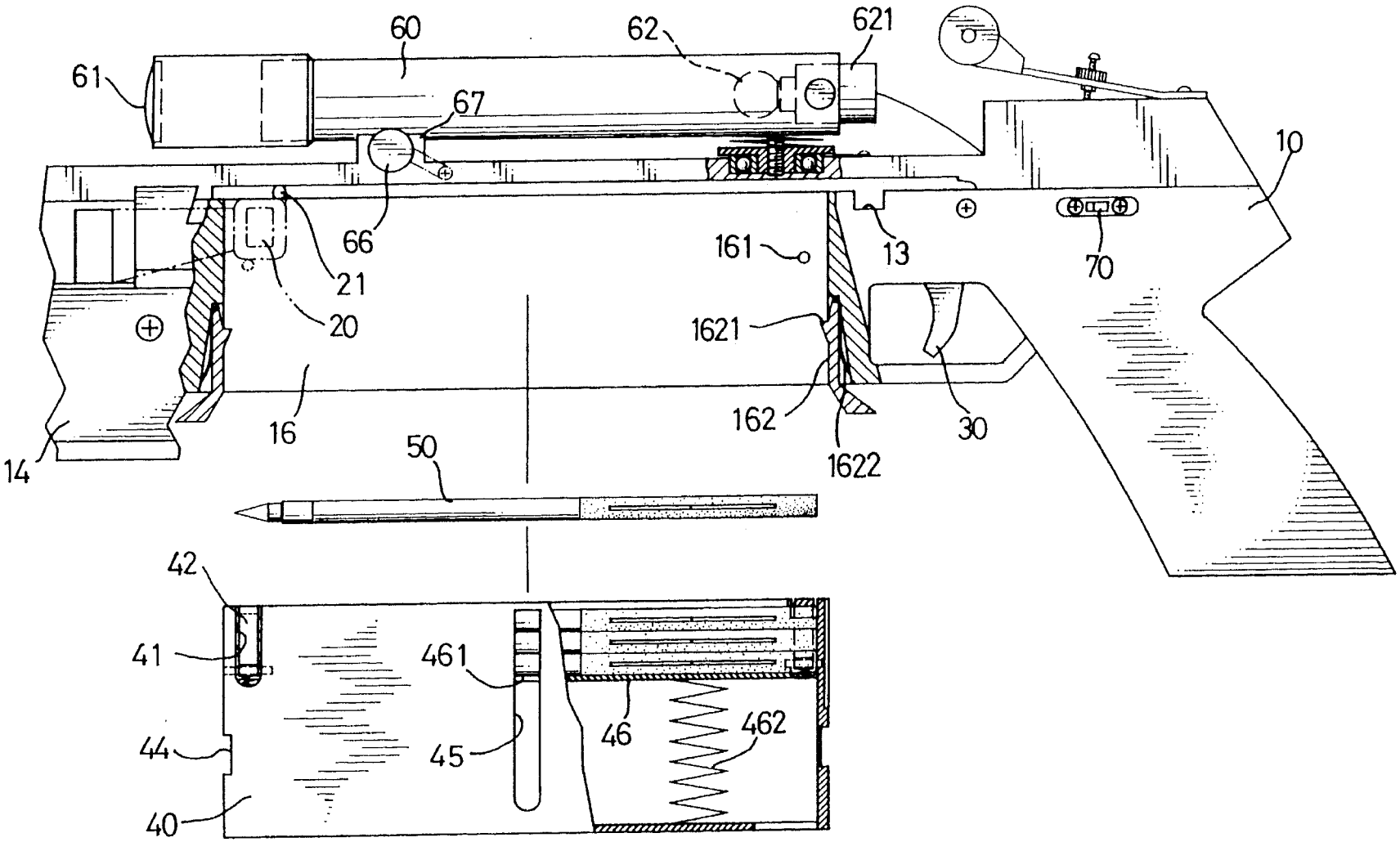
FIG. 4 is an exploded side view, partly cut away, of a magazine of the arrow storing means and the frame of the crossbow in accordance with the present invention.
Figure 5:
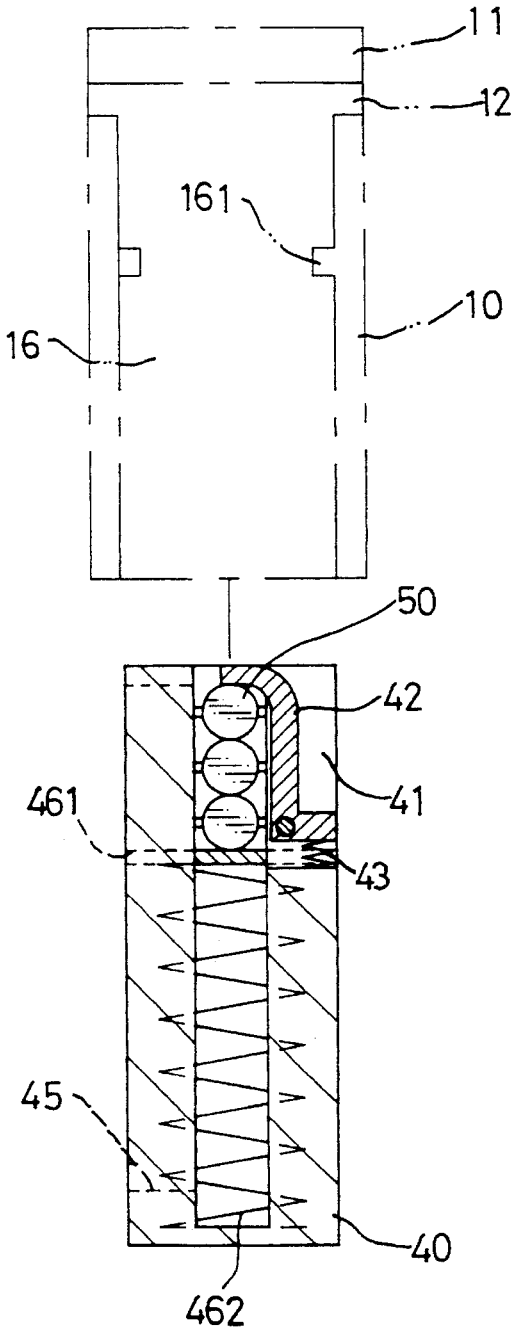
FIG. 5 is an end elevational view in cross-section of the magazine in accordance with the present invention wherein a Z-shaped element is disposed in a side of the magazine and which has an upper end holding the arrows received in the magazine.
Figure 6:
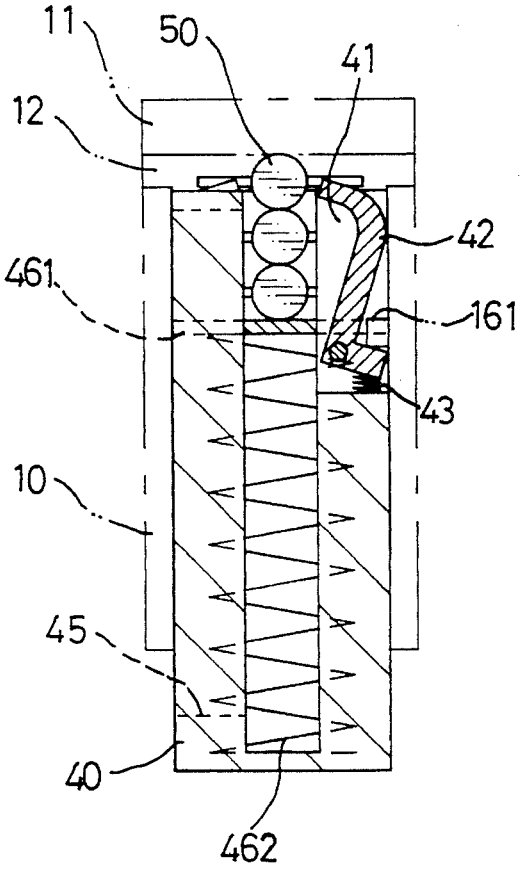
FIG. 6 is an end elevational view in cross-section of the magazine inserted into the frame in accordance with the present invention wherein a lower end of the Z-shaped element is pushed by a protrusion of the frame to disengage the upper end of the Z-shaped element from the arrows received in the magazine.
Figure 7:
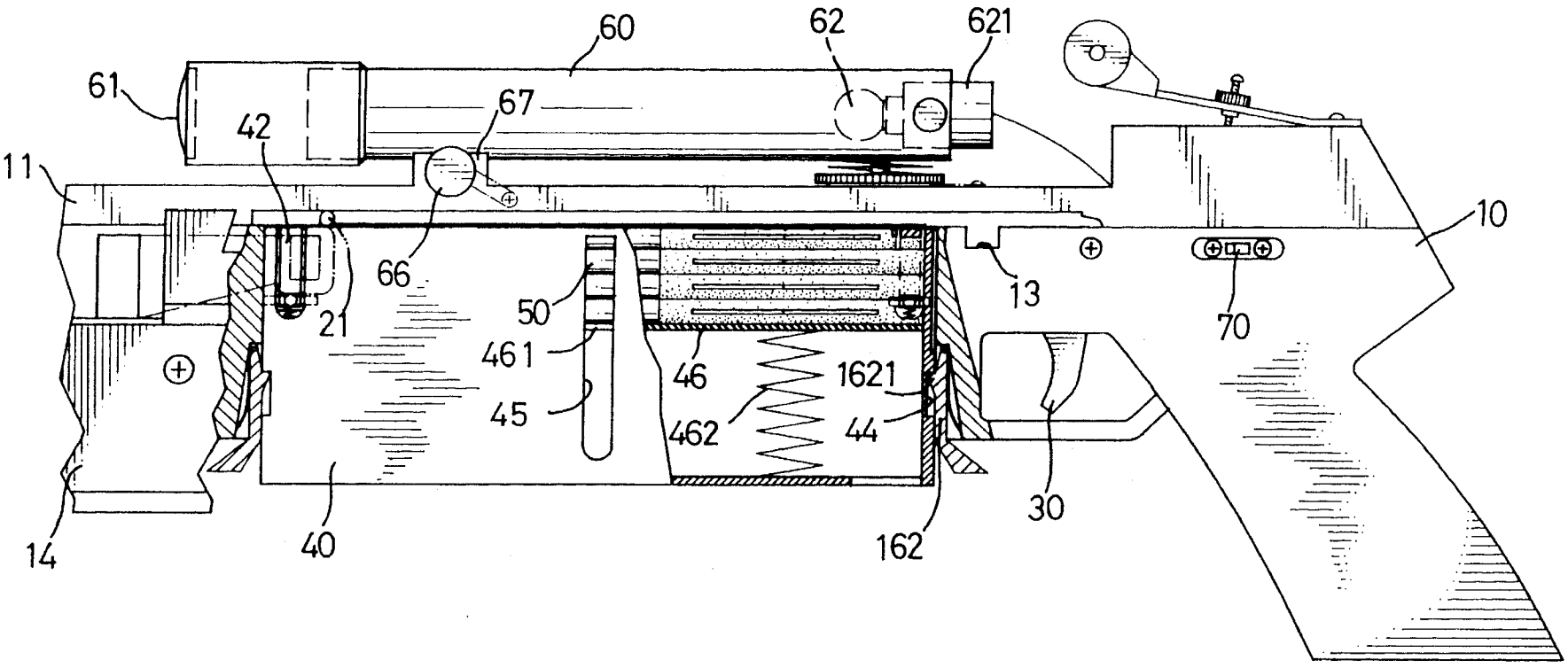
FIG. 7 is a side elevational view, partly cut away, of the magazine inserted into the frame in accordance with the present invention.
Figure 8:
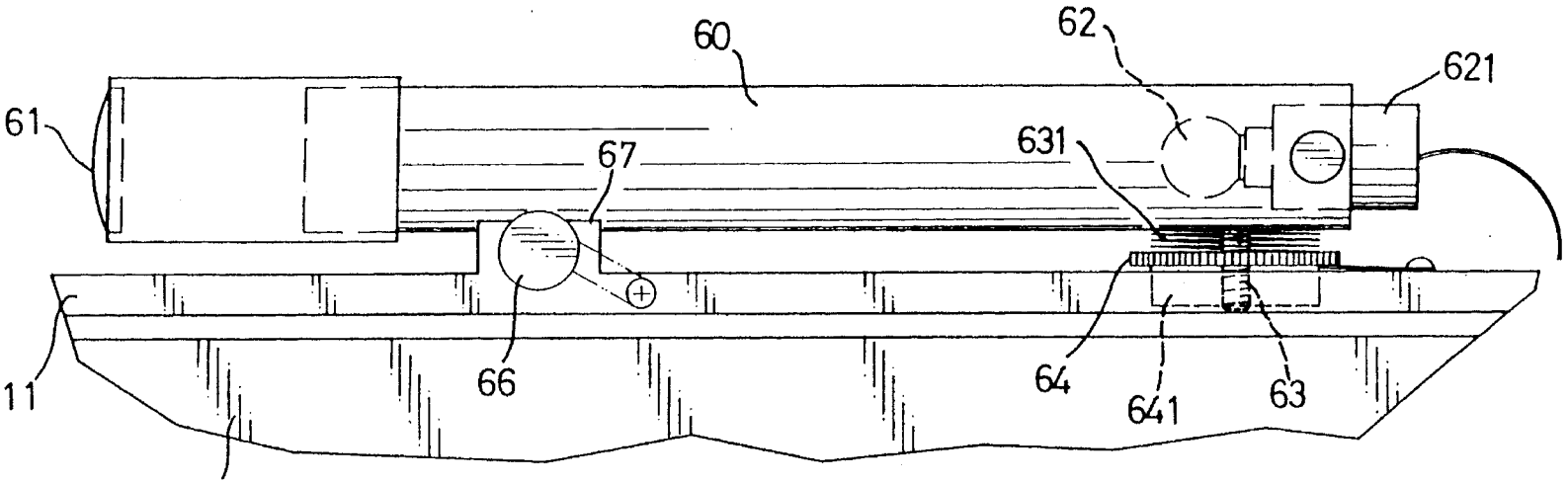
FIG. 8 is a side elevational view of the aiming means disposed on an upper end of the frame in accordance with the present invention.
Figure 9:
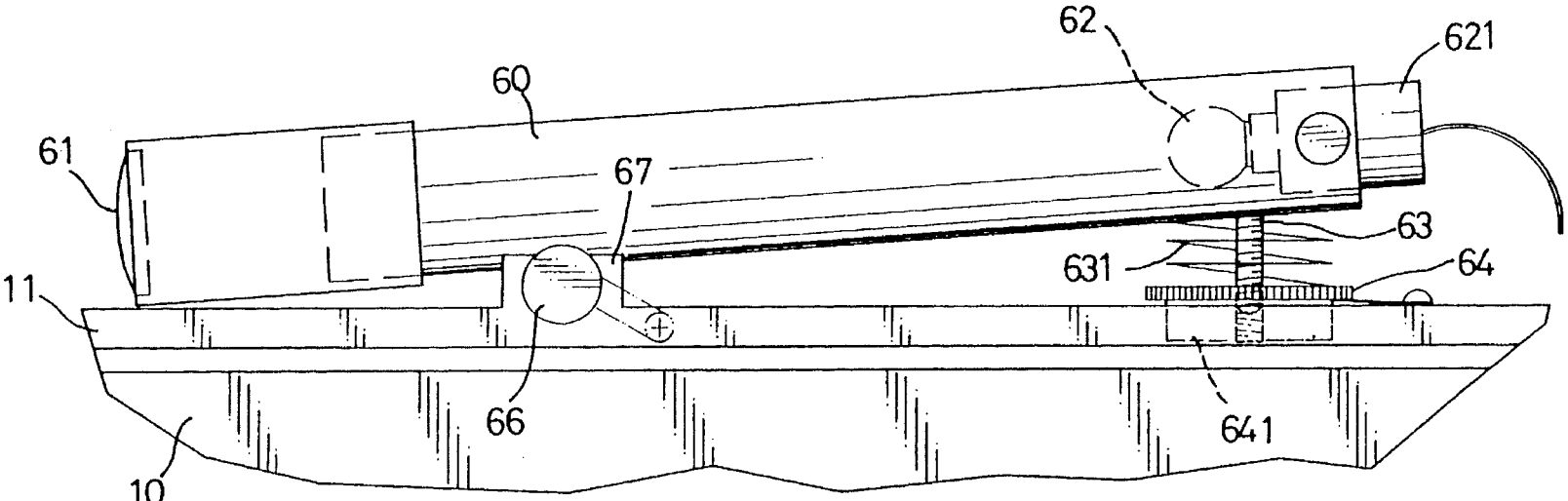
FIG. 9 is a side elevational view of a first end of the aiming means raised by adjusting an adjusting element disposed thunder the aiming means.
Figure 10:
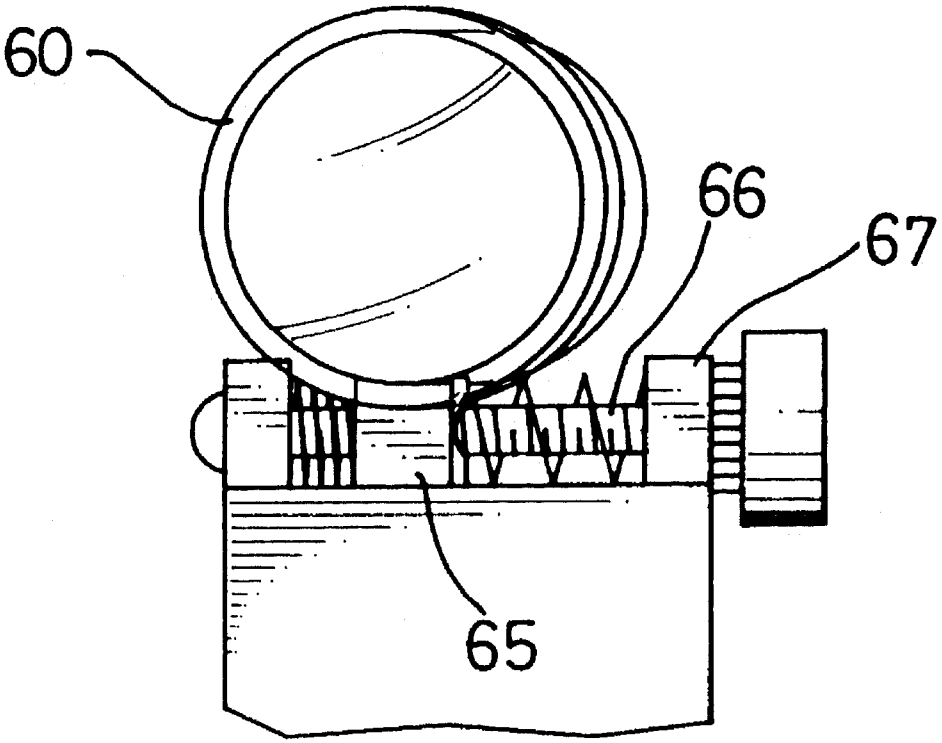
FIG. 10 is a side elevational view of a second end of the aiming means shifted by rotating a bolt disposed laterally beneath the aiming means.

Referring to the drawings and initially to FIGS. 1 through 3, the crossbow generally includes a frame 10, a bow 20, a bow string 21 and an activating means which includes a trigger 30 and an activating element 31. The frame 10 has an upper cover 11 disposed on an upper end of the frame 10 and which defines a slot 12 between the frame 10 and the upper cover 11. The crossbow has an opening (figure not shown) defined in a front end thereof and which communicates with the slot 12. The bow 20 is fixedly and transversely engaged to the frame 10 and beneath the upper cover 11 such that the bow string 21 can move freely within the slot 12.

The activating means (see FIG. 2) is disposed in the frame 10 and the trigger 30 having first and second ends 301, 302 is pivotally engaged in the frame 10, the first end 301 of the trigger 30 is disposed above and contacts a first end 311 of the activating element 31 which is pivotally engaged in the frame 10. A recess 13 is defined in the frame and communicates with the slot 12 such that the bow string 21 can be pulled and put into the recess 13. The bow string 21 is disengaged from the recess 13 by pulling the trigger 30 such that a second end 312 of the activating element 31 will move upwardly from the recess 13 and therefore disengages the bow string 21 from the recess 13.

A pulling bracket 14 is a U-shaped element and is slidably mounted to an under portion of the frame 10 by two rollers 142 rotatably disposed between the frame 10 and the pulling bracket 14, each roller 142 has a pin 143 disposed therein. The rollers 142 slide on a loop trail 15 projecting from the frame 10. The frame 10 has a transversely defined recess in which a ball 151 and a spring 152 are inserted and the pin 143 has a recess defined in its distal end for engaging with the ball 151 to set the pulling bracket 14 in position. A notch 141 is defined in each upper end of the pulling bracket 14 and is positioned between the bow 20 and the bow string 21 in order to receive the bow string 21 therein when pulling the pulling bracket 14.

Please refer to FIGS. 4 to 7, the frame 10 has a receiving chamber 16 defined by four inner sides thereof for receiving an arrow storing means, a magazine 40 for example, and the receiving chamber 16 communicates with the slot 12. A protrusion 161 projects from two opposite inner sides and a hook element 162 is pivotally engaged to the other two opposite inner sides respectively. The hook element 162 has a hook part 1621 projecting into the receiving chamber 16 and a spring 1622 disposed between the inner side of the receiving chamber 16 and the hook element 162 such that the hook part 1621 will be removed from the receiving chamber 16 by pulling a lower portion of the hook element 162.

The magazine 40 is a box enclosed by a bottom and four sides and has an upper open end, a U-shaped opening 41 is defined in two opposite sides thereof and a Z-shaped element 42 is pivotally engaged in the U-shaped opening 41 with a spring 43 disposed between a lower end of the Z-shaped element 42 and a bottom of the U-shaped opening 41, and an oblong slot 45 is defined in a middle part of the two opposite sides as previously mentioned. A side recess 44 is defined in the other two opposite sides of the magazine 40 for engagement with the hook part 1621 of the hook element 162 when the magazine 40 is inserted into the receiving chamber 16. A plate 46 is disposed in the magazine 40 and has two protrusions 461 passing through the oblong slots 45 preventing the plate 46 disengaging from the magazine 40, a spring 462 is disposed between the plate 46 and the bottom of the magazine 40 to push the plate upward.

A plurality of arrows 50 are inserted in the magazine 40 and are put on the plate 46 in sequence such that the uppermost arrow 50 in the magazine 40 is restrained by an upper end of the two Z-shaped elements 42 such that the arrows 50 in the magazine 40 can be maintained in the magazine 40. When using the crossbow, a user inserts the magazine 40 into the receiving chamber 16 of the frame 10, the protrusions 161 of the inner sides of the receiving chamber 16 will push the lower end of the Z-shaped element 42 downward and the upper end of the Z-shaped element 42 is then away from the uppermost arrow 50 in the magazine 40 such that the uppermost arrow 50 is restrained only by the bow spring 462.

Figure 11:
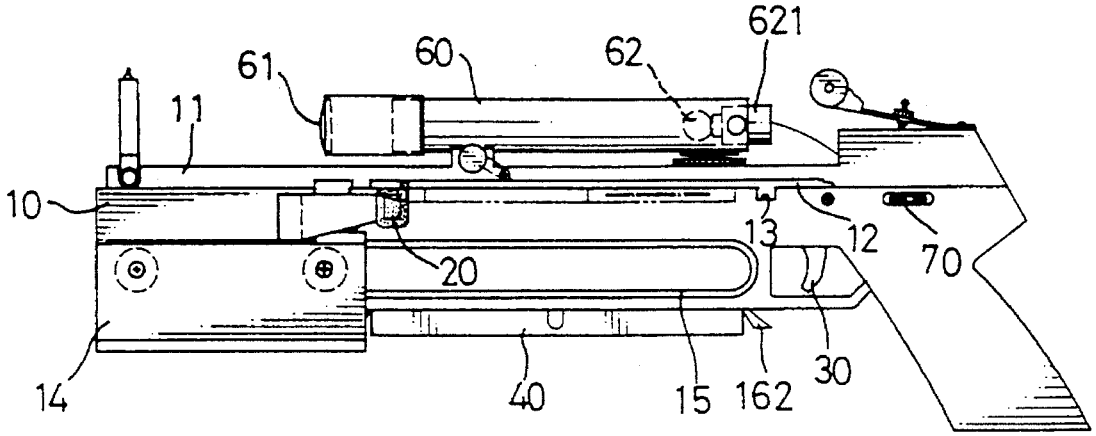
FIG. 11 is a side elevational view in accordance with the present invention wherein the magazine is inserted into the frame.
Figure 12:
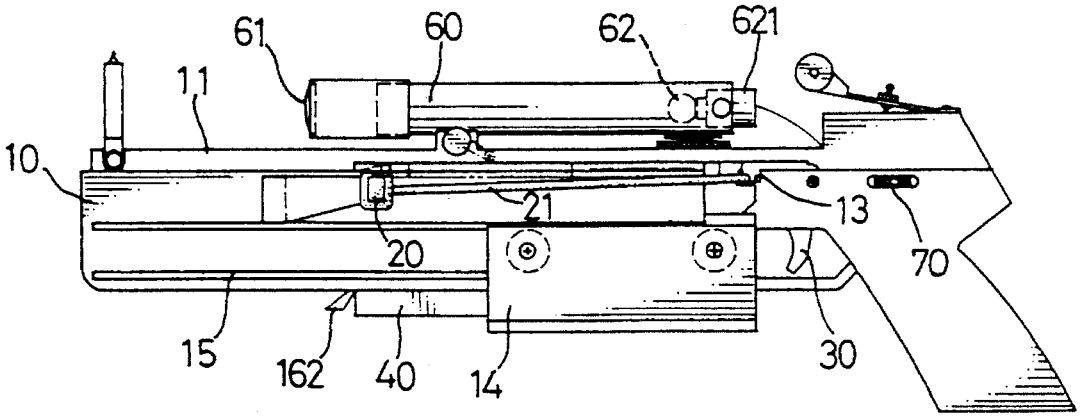
FIG. 12 is a side elevational view in accordance with the present invention wherein the pulling bracket is pulled to put a bow string of the bow into a recess defined in the frame.
Figure 13:
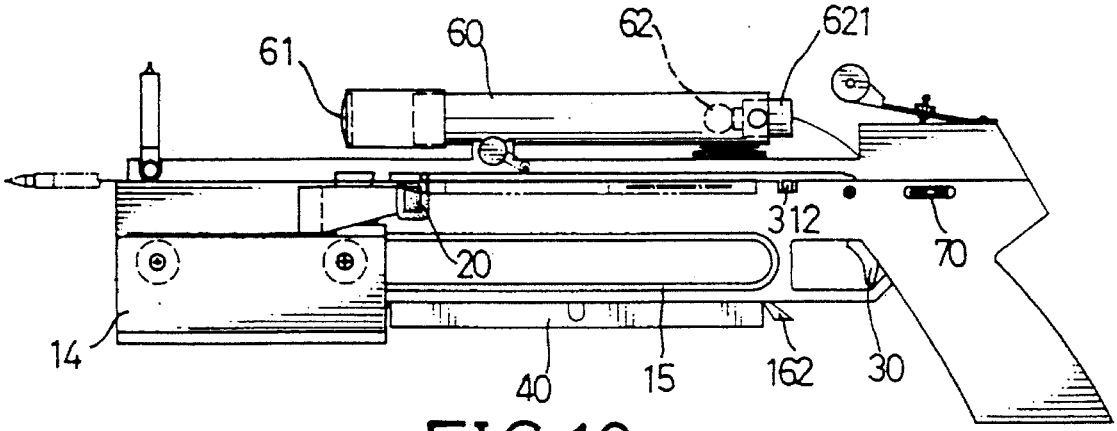
FIG. 13 is a side elevational view in accordance with the present invention wherein the bow string is pushed out from the recess by pulling a trigger disposed in the frame.

Before shooting, referring to FIGS. 11 to 13, the user pulls the pulling bracket 14 toward to the recess 13 and the bow string 21 positioned above the uppermost arrow 50 in the slot 12 is received in the notch 141 and is pulled and put in the recess 13, the uppermost arrow 50 is therefore moved into the slot 12 by the spring 462. Once the trigger 30 is pulled, the activating end of the activating element 31 will push the bow string 21 out from the recess 13 and which will shoot the arrow 50 from the opening defined in the front end of the frame 10 at a high speed. The following arrow 50 in the magazine 40 is then pushed upward by the spring 462.

Referring to FIGS. 1, 4, 8, 9 and 10, the aiming means includes a tube 60 having first and second ends, a convex lens 61 is disposed in the first end of the tube 60 and a bulb 62, the bulb 62 is disposed in a base 621 which is rotatably engaged to the second end of the tube 60. An electrical device (figures not shown) is equipped in the frame 10 and which has a switch 70 disposed in a side of the frame 10. A distance between the bulb 62 and the convex lens 61 can be adjusted by moving the base 621 within the tube 60 such that a spot will projected on a target for the convenience of aiming. A first plate 32 has a first end fixed and connected to the electrical device and a second end contacting upon the second end 302 of the trigger 30 and a second plate 33 has a first end fixed and connected to the electrical device and a second end being disposed above the second end of the first plate 32 defining a gap. When the trigger 30 is pulled, the second end 302 of the trigger 30 pushes the first end of the first plate 32 to contact the first end of the second plate 33 and therefore forms a circuit such that the bulb 62 is turned on and a spot of light will be produced through the convex lens 61. A bolt 63 projects from an under portion and near the second end of the tube 60. A spring 631 mounted to the bolt 63 is threadedly engaged to an adjusting element 64 which is rotatably engaged to the upper cover 11 by a bearing 641 providing the adjusting element 64 with better self-rotating feature such that the second end of the tube 60 can be lifted by rotating the adjusting element 64. The tube 60 has a flange 65 projecting downwardly from the under portion thereof and near the first end thereof and a threaded hole (figure not shown) is defined in the flange 65.

A bolt 66 is engaged through the threaded hole with both its ends supported by two plates 67 extending upwardly from the upper cover 11 and positioned on both sides of the tube 60, a spring is mounted to the bolt 66 between each plate 67 and the flange 65 such that the tube 60 can be adjusted in horizontal direction by rotating the bolt 66. A purpose of disposing the adjusting element 64 and the flange 65 is to provide a convenience of checking the aiding feature, such as to make sure of the tube 60 having the same axis with the frame 10, to ensure the arrow 50 will hit the spot projected from the convex lens 61.

Although the invention has been explained in relation to its preferred embodiment, it is to be understood that many other possible modifications and variations can be made without departing from the spirit and scope of the invention as hereinafter claimed.

I claim:

1. An arrow storing means for a crossbow, said crossbow comprising a frame, a bow engaged to said frame and an activating means disposed in said frame, said crossbow comprising a bow and a bow string, a slot defined in said frame and a recess defined in said frame and communicating with said slot in which said bow string is disposed, said frame having a receiving chamber defined in an under side thereof, said receiving chamber having four inner sides and communicating with said slot and said activating means can move within said recess;

said arrow storing means comprising:

a magazine replaceably disposed in said receiving chamber of said frame, said magazine having four sides, an opening and a bottom, at least one spring disposed in said magazine and connected to a plate and said bottom with two ends thereof respectively so as to push said plate upwardly within said magazine, at least one U-shaped recess defined in one side of said magazine and a Z-shaped element pivotally engaged in said U-shaped recess, a spring being disposed between said U-shaped recess and a lower end of said Z-shaped element such that an uppermost arrow disposed in said magazine is held by an upper end of said Z-shaped element.

2. The arrow storing means as claimed in claim 1 wherein said magazine has at least one side recess defined in one side thereof and at least one hook element pivotally engaged in one inner side of said receiving chamber, corresponding to said side recess, a spring is disposed between said hook element and said inner side of said receiving chamber such that said magazine is securely engaged in said receiving chamber of said frame by engagement of said hook element and said side recess.

3. The arrow storing means as claimed in claim 1 wherein said magazine has an oblong slot defined in two opposite sides thereof and said plate has two protrusions passing through said oblong slots.

4. The arrow storing means as claimed in claim 1 wherein said receiving chamber of said frame has at least one protrusion projecting outwardly from one inner side of said receiving chamber for pressing said lower end of said Z-shaped element to disengage said upper end thereof from said uppermost arrow when inserting said magazine into said receiving chamber.

5. An aiming means for a crossbow, said crossbow comprising a frame, a bow engaged to said frame and an activating means disposed in said frame, said crossbow comprising a bow and a bow string, a slot defined in said frame and a recess defined in said frame and communicating with said slot in which said bow string is disposed;

said aiming means adjustably engaged to an upper end of said frame and comprising a tube having first and second ends, a convex lens disposed in said first end of said tube, a bulb removably disposed in said second end of said tube and an electrical device disposed in said frame for providing electricity to said bulb, said tube having a flange projecting from said under side thereof in which a threaded hole is defined, a bolt engaged through said threaded hole and being supported by two plates projecting from said frame and positioned on both sides of said tube.

6. The aiming means as claimed in claim 5 wherein said bulb is disposed in a base which is movably engaged in said second end of said tube.

7. The aiming means as claimed in claim 5 wherein said tube has a bolt projecting from an under portion thereof and is threadedly engaged through an adjusting element which is rotatably engaged to said frame by a bearing disposed therein.

8. An arrow storing means and an aiming means for a crossbow, said crossbow comprising a frame, a bow engaged to said frame and an activating means disposed in said frame, said crossbow comprising a bow and a bow string, a slot defined in said frame and a recess defined in said frame and communicating with said slot in which said bow string is disposed, said frame having a receiving chamber defined in an under side thereof, said receiving chamber having four inner sides and communicating with said slot, said aiming means disposed to an upper end of said frame and said activating means can move within said recess;

said arrow storing means comprising:

a magazine replaceably disposed in said receiving chamber of said frame, said magazine having four sides, an opening and a bottom, at least one spring disposed in said magazine and connected to a plate and said bottom with two ends thereof respectively so as to push said plate upwardly within said magazine, said magazine having at lest one U-shaped recess defined in one side thereof and a Z-shaped element pivotally enagaged in said U-shaped recess, a spring being disposed between said U-shaped recess and a lower end of said Z-shaped element such that an uppermost arrow disposed in said magazine is held by an upper end of said Z-shaped element.

9. The arrow storing means and the aiming means as claimed in claim 8 wherein said aiming means is adjustably engaged to an upper end of said frame and comprising a tube having first and second ends, a convex lens disposed in said first end of said tube, a bulb movably disposed in said second end of said tube and an electrical device disposed in said frame for providing electricity to said bulb.

10. The arrow storing means and the aiming means as claimed in claim 9 wherein said bulb is disposed in a base which is movably engaged in said second end of said tube.

11. The arrow storing means and the aiming means as claimed in claim 9 wherein said tube has a bolt projecting from an under portion thereof and threadably engaged through an adjusting element which is engaged to a bearing disposed in said frame.

12. The arrow storing means and the aiming means as claimed in claim 9 wherein said tube has a flange projecting from said under side thereof in which a threaded hole is defined, a bolt engaged through said threaded hole is supported by two plates projecting from said frame and positioned on both sides of said tube.

13. The arrow storing means and the aiming means as claimed in claim 8 wherein said magazine has at least one side recess defined in one side thereof and at least one hook element is pivotally engaged in one inner side of said receiving chamber, corresponding to said side recess, a spring is disposed between said hook element and said inner side of said receiving chamber such that said magazine is securely engaged in said receiving chamber of said frame by engagement of said hook element and said side recess.

14. The arrow storing means and the aiming means as claimed in claim 8 wherein said magazine has an oblong slot defined in two opposite sides thereof and said plate has two protrusions passing through said oblong slots.

15. The arrow storing means and the aiming means as claimed in claim 8 wherein said receiving chamber of said frame has at least one protrusion projecting outwardly from one inner side of said receiving chamber for pressing said lower end of said Z-shaped element to disengage said upper end thereof from said uppermost arrow when inserting said magazine into said receiving chamber.

* * * * *